US008240330B2

(12) United States Patent
Moore et al.

(10) Patent No.: US 8,240,330 B2
(45) Date of Patent: Aug. 14, 2012

(54) SQUEEZE FILM DAMPER VALVE FOR COMPRESSOR CYLINDERS

(75) Inventors: James J. Moore, San Antonio, TX (US); Timothy C. Allison, San Antonio, TX (US); Andrew H. Lerche, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 193 days.

(21) Appl. No.: 12/544,045

(22) Filed: Aug. 19, 2009

(65) Prior Publication Data

US 2011/0041929 A1 Feb. 24, 2011

(51) Int. Cl.
*F16K 17/02* (2006.01)

(52) U.S. Cl. ..... 137/516.19; 137/516.25; 137/514; 137/512

(58) Field of Classification Search ..... 137/514, 137/516.11, 516.13, 516.17, 516.25, 516.27, 137/515.7, 533.21, 516.19, 514.7, 516.15, 137/512.1, 516.21, 516.23
See application file for complete search history.

(56) References Cited

U.S. PATENT DOCUMENTS

| | | | | |
|---|---|---|---|---|
| 83,302 | A * | 10/1868 | Nichols | 137/512 |
| 957,012 | A * | 5/1910 | Stone | 137/516.13 |
| 2,011,547 | A * | 8/1935 | Campbell | 137/516.29 |
| 4,869,291 | A | 9/1989 | Hrabal | |
| 2007/0272178 | A1 | 11/2007 | Brun et al. | |

OTHER PUBLICATIONS

International Search Report for PCT/2009/038837 published May 29, 2009.

* cited by examiner

*Primary Examiner* — Kevin Lee
*Assistant Examiner* — Macade Brown
(74) *Attorney, Agent, or Firm* — Chowdhury & Georgakis PC; Ann C. Livingston

(57) ABSTRACT

A compressor plate valve having a valve seat, a valve guard and a valve plate. The valve plate is moveable between the valve guard and valve seat to control fluid passage through passages in the seat, the guard, and the plate. A valve stem passes through the center of the valve guard and is attached to the center of the valve plate. The valve stem provides guidance for the plate valve to ensure parallel motion. In addition to sealing surfaces that oppose passages, the seat and plate have landing surfaces that provide a braking effect when the valve closes through squeeze film action.

10 Claims, 3 Drawing Sheets

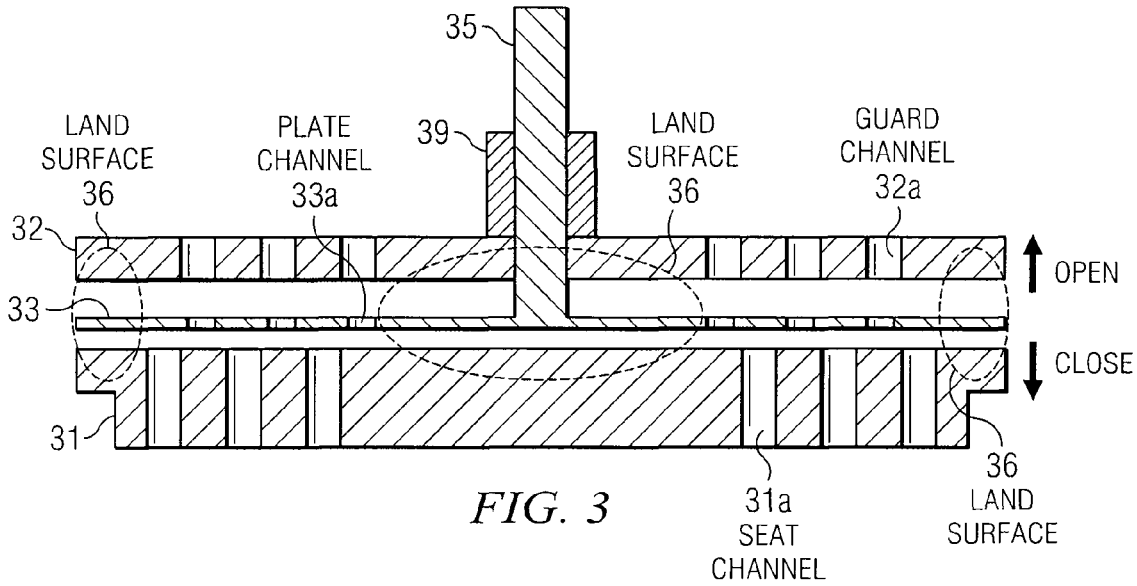
FIG. 3
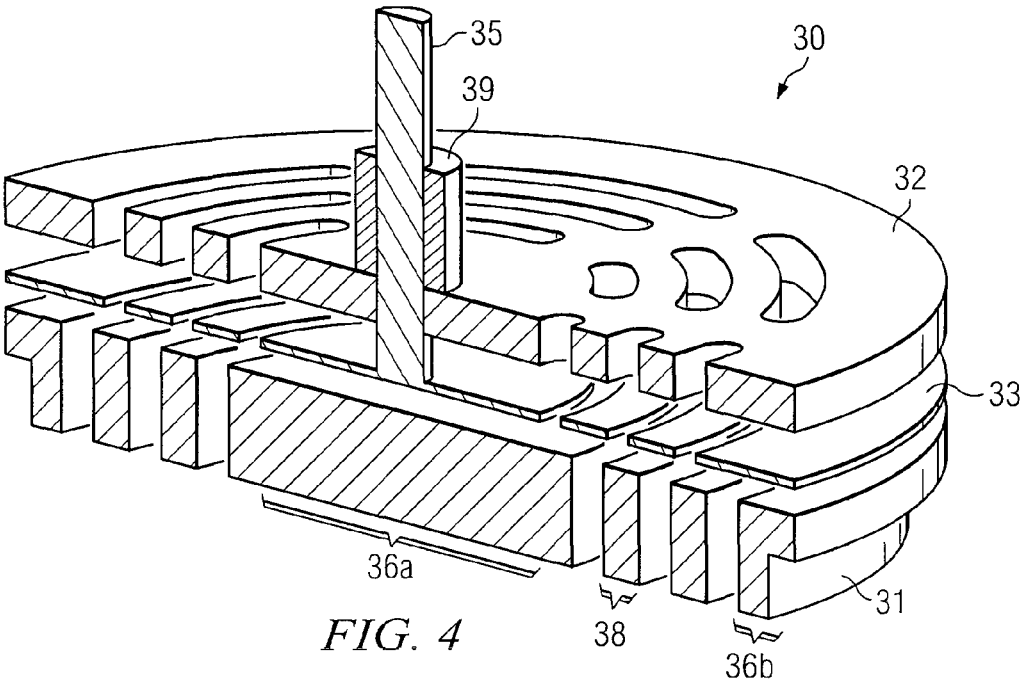
FIG. 4
| PLATE VALVE GAP (h) (mm) [in] | SQUEEZE FILM FORCE (F) (N) [lbf] |
|---|---|
| 1mm [0.040"] | 0.19 N [0.042 lbf] |
| 0.1mm [0.004"] | 191 N [42 lbf] |
| 0.05mm [0.002"] | 1532 N [345 lbf] |
| 0.025mm [0.001"] | 12252 N [2756 lbf] |
FIG. 5

SQUEEZE FILM DAMPER VALVE FOR COMPRESSOR CYLINDERS

TECHNICAL FIELD OF THE INVENTION

This invention relates to reciprocating compressors for transporting natural gas or other gases, and more particularly to an improved cylinder valve for such compressors.

BACKGROUND OF THE INVENTION

Reciprocating compressors are used in a great many industries, including oil refineries, gas pipelines, chemical plants, natural gas processing plants and refrigeration plants. For example, to transport natural gas from production sites to consumers, pipeline operators install large compressors at transport stations along the pipelines. Natural gas pipeline networks connect production operations with local distribution companies through thousands of miles of gas transmission lines. Typically, reciprocating gas compressors are used as the prime mover for pipeline transport operations because of the relatively high pressure ratio required.

Reciprocating compressors compress fluid using a piston in a cylinder connected to a crankshaft. The crankshaft may be driven by a motor or an engine. A suction valve in the compressor cylinder receives input gas, which is then compressed by the piston and discharged through a discharge valve.

A specific challenge when using high-horsepower, high-speed, variable-speed compressors is failure of the compressor valves. A common type of valve used for reciprocating compressors is a plate-type compressor valve. These valves experience high plate impact velocities that often result in fatigue failures and a short operating life, leading to frequent valve replacement. Studies have identified impact velocity, which is the velocity of the valve plate when it reaches the limit of its travel, as a significant factor in assessing valve life.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 3 is a cross sectional view of a squeeze film damper valve in accordance with the invention.

FIG. 4 is a perspective view of the valve of FIG. 3.

FIG. 5 is a table showing increased damping force as the sealing plate nears the valve seat.

DETAILED DESCRIPTION OF THE INVENTION

The following description is directed to an improved compressor plate valve for reciprocating compressors. By "reciprocating compressor" is meant a positive-displacement compressor that uses pistons driven by a crankshaft to deliver gases (or other fluids) at high pressure. Intake gas flows into the compression cylinder where it is compressed by a piston driven in a reciprocating motion via a crankshaft, and is then discharged. The movement into and out of the cylinders is via cylinder intake and discharge valves.

As explained below, the improved valve is based on a "squeeze film" concept to reduce the impact velocity of the valve plate. As explained below, squeeze film lands are added to valve surfaces to provide the squeeze film effect.

Figure 1:
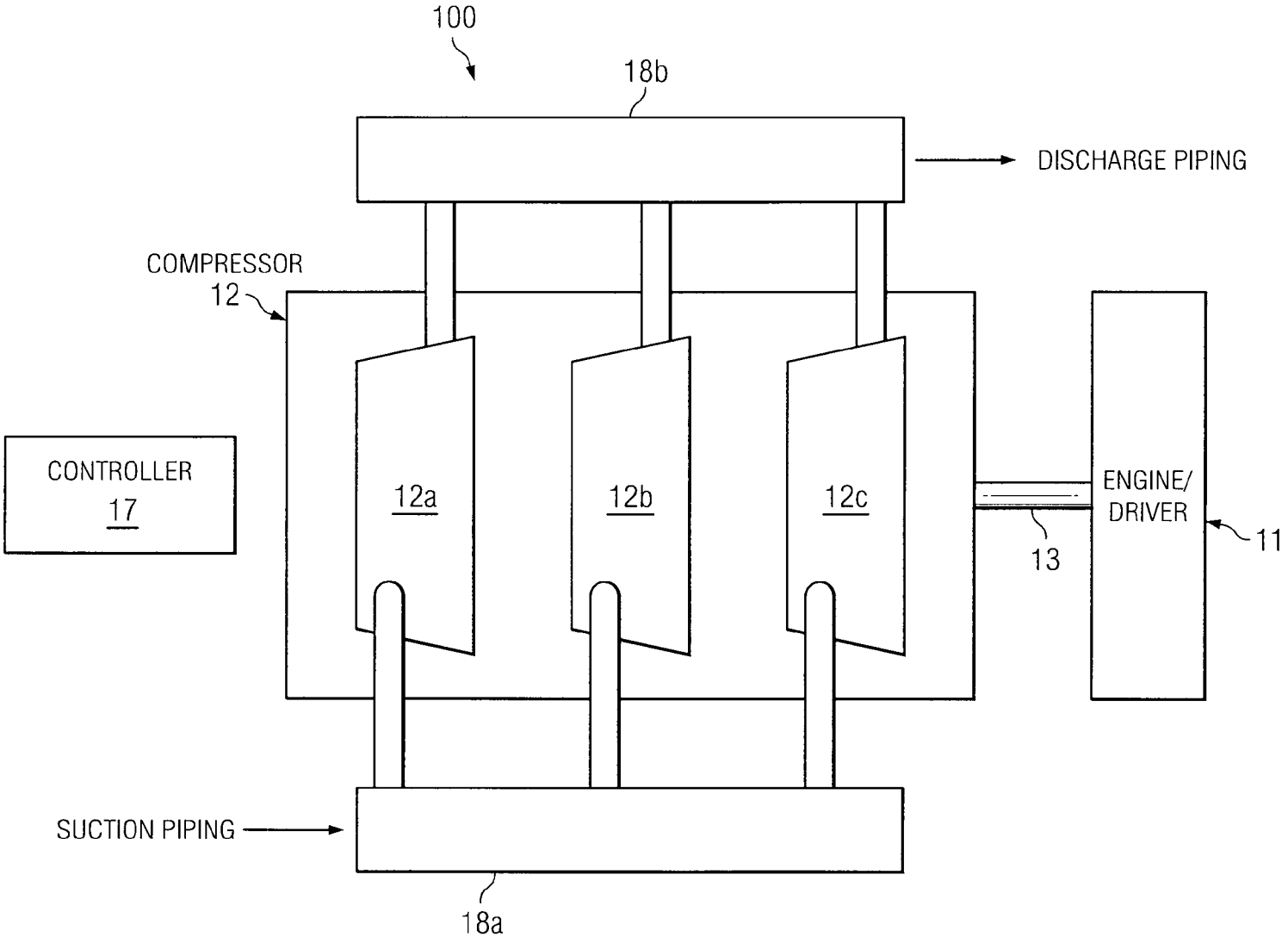
FIG. 1 is a block diagram of a reciprocating gas compressor system.

FIG. 1 is a block diagram of the basic elements of a reciprocating gas compressor system 100. The elements of compressor system 100 are depicted as those of a typical or "generic" system, and include a driver 11, compressor 12, suction filter bottle 18*a*, discharge filter bottle 18*b*, suction and discharge piping connections, and a controller 17.

In the example of FIG. 1, compressor 12 has three compressor cylinders 12*a*-12*c*. In practice, compressor 12 may have fewer or more (often as many as six) cylinders. Compressor valves (not explicitly visible in FIG. 1) are installed on each cylinder 12*a*-12*c* to permit one-way flow into or out of the cylinder volume.

Compressor 100 may have either an integral or separate engine or motor driver 11. The output of driver 11 (motor or engine) is unloaded through the compressor. The driver 11 is often an internal combustion engine.

Filter bottles 18*a* and 18*b* are placed between the compressor and the lateral piping, on the suction or discharge side or on both sides. Filter bottles such as these are installed as a common method for pulsation control.

Controller 17 is used for control of parameters affecting compressor load and capacity. The pipeline operation will vary based on the flow rate demands and pressure variations. The compressor must be capable of changing its flow capacity and load according to the pipeline operation. Controller 17 is equipped with processing and memory devices, appropriate input and output devices, and an appropriate user interface. It is programmed to perform the various control tasks and deliver control parameters to the compressor system. Given appropriate input data, output specifications, and control objectives, algorithms for programming controller 17 may be developed and executed.

Figure 2:
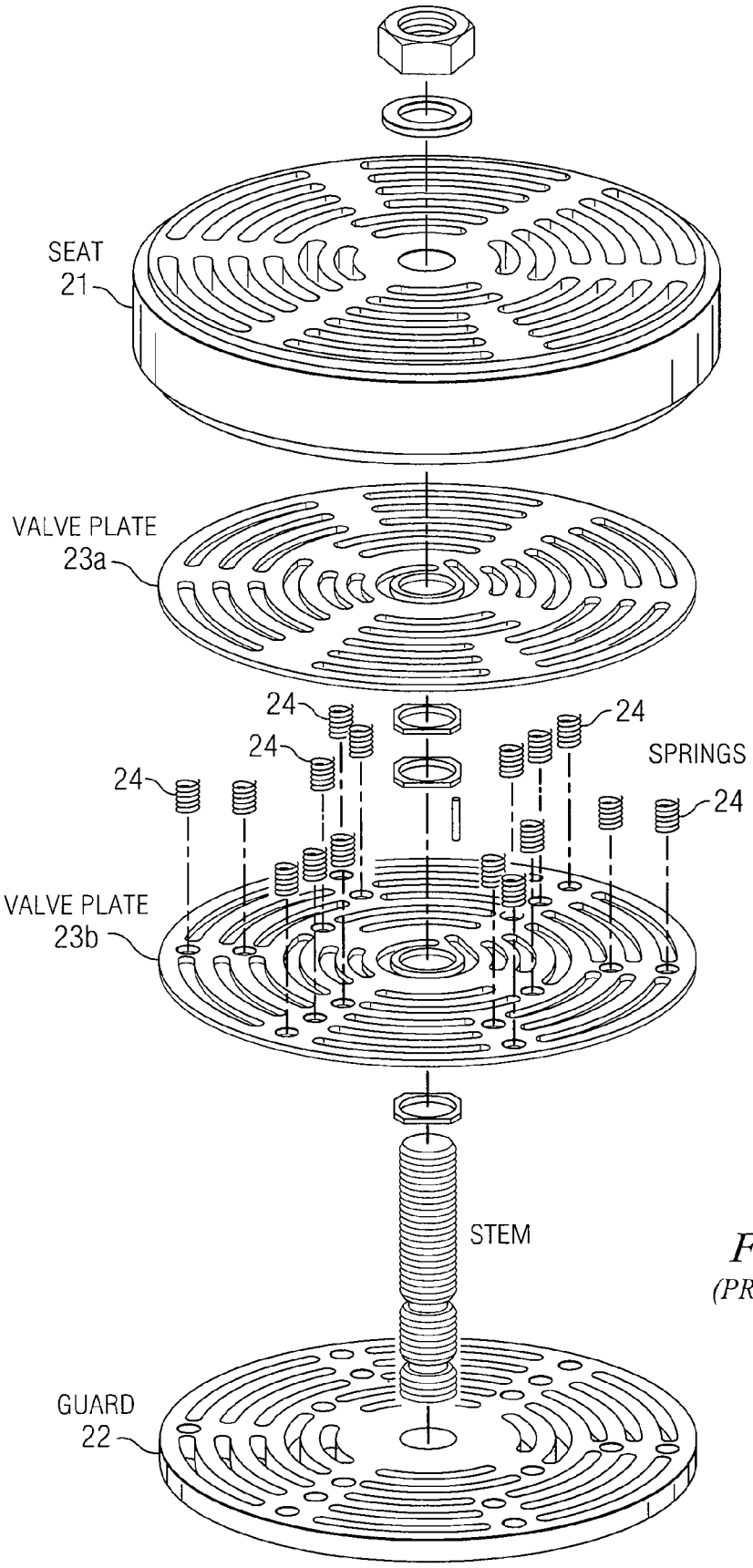
FIG. 2 (PRIOR ART)
FIG. 2 illustrates a conventional plate valve.

FIG. 2 illustrates a conventional plate valve 20 for compressor cylinders, such as cylinders 12*a*-12*c*. A valve seat 21 has passage channels for the gas delivered by the compressor. A guard 22 also has passage channels, as do one or more valve plates 23. The valve plates 23 are moveable between the seat 21 and the guard 22 to control flow through the passage channels.

In the example of FIG. 2, valve 20 has two plates, a sealing plate 23*a* and a damping plate 23*b*. In conventional valves, one plate is a sealing plate and one or more additional plates are spring or damper plates.

The passages in valve plates 23 are opposed by sealing surfaces 38, so that when the valve is operated, fluid will flow or not flow through the valve. More specifically, when valve 30 is closed, each passage is sealed closed by a sealing surface. Springs 24 are used to hold the valve closed, and fluid flow direction determines whether fluid will flow or not flow through the valve. Stem 25 may be used to move the valve plate 23*a* against the closure force of the springs 24 to open the valve, which allows throughput to be controlled.

FIG. 3 illustrates a squeeze film damper valve 30 in accordance with the invention. Like valve 20, valve 30 has a seat 31, a guard 32, and a sealing plate 33. As explained below, valve 30 may or may not have one or more damper plates (not shown). Valve 30 is closed by the action of plate 33 against seat 31, and has springs (or some other counter force) similar to those of valve 20. Stem 35 moves up or down to counteract the closure force of the springs.

Valve 30 differs from a conventional valve in at least two ways. First, there are squeeze film lands (landing surfaces) 36 added to the outside diameter of the plate valve as well as at the inner diameter near the centerline. The lands 36 add surface area to each of these elements at their outer diameters and at their centers.

Lands 36, in effect, increase the circumference of the valve 30 by increasing the circumference of the seat 31, guard 32, and plate 33. Because of the addition of the landing surfaces 36, valve 30 is slightly wider than a conventional valve, but this can be incorporated into the head design. Alternatively, the valve diameter can be kept the same as a conventional plate valve by reducing the flow area. The increase in pressure drop can be eliminated by increasing the valve lift made possible by the squeeze film damper valve, since the impact velocities would be reduced to acceptable levels.

As illustrated in FIG. 3, lands 36 are not for sealing—they are in addition to the surface area that would be required for sealing the valve passage channels, such as passage channels 31*a*, 32*a* and 33*a*. The "sealing surfaces" 38 are the surfaces that oppose the passage channels, and are required for sealing the valve in the closed position.

It can be seen that without the additional surfaces provided by the lands 36, the valve could provide the required sealing effect and that the lands 36 are superfluous to the sealing surfaces. The additional surface areas provided by the land surfaces 36 provide the squeeze film effect, which results in improved braking and damping force as the valve nears its closed position.

In the example of FIG. 3, valve 30 is configured for providing a damping effect on both opening and closing. Landing surfaces are present in the valve guard 32, as well as the valve seat 31 and valve plate 33. It can be seen, however, that the valve guard 32 could have additional passage channels instead of landing surfaces. Valve 30 has sealing plate 33 and no damper plates if damping is desired for both opening and closing of the valve. Alternatively, valve 30 have one or more damper plates (not shown), and squeeze film damping would occur on valve closure.

Referring in particular to FIG. 4, in an exemplary embodiment, an inner landing surface 36*a* comprises about the inner ½ of the total diameter of valve 30. The passages and their opposing sealing surfaces 38 comprise the next ⅜ of the diameter. An outer landing surface 36*b* comprises approximately the outer ⅛ of the total diameter. The relative portions of the total valve diameter allotted to the inner landing surface, the sealing surfaces, and the outer landing surfaces may vary, but it is expected that the inner landing surface 36*a* will comprise at least ⅓ of the total valve diameter and that the outer landing surface 36*b* will comprise at least ⅛.

Valve stem 35 does not pass through plate 33, but rather passes through guard 32 and is attached to plate 33 at its proximal end. Bushing 39 is attached to the center of valve guard 32 and extends distally from valve guard 32. The inner diameter of bushing 39 is slightly larger than the outer diameter of stem 35. Bushing 39 provides a supportive sleeve for valve stem 35 as valve stem 35 moves upwardly or downwardly inside bushing 39. Bushing 39 ensures the surface of plate 33 remains parallel with the valve seat 31 and does not contact on one edge that would render the squeeze film effect less effective.

The squeeze film concept is based on the fact that two plates approaching one another must displace fluid between them. As the gap between the plates decreases, the fluid velocity increases, as does the associated shearing of the fluid. The net effect is a force that opposes the plate velocity. This force is referred to herein as the valve damping force.

In the example of this description, the fluid between the plates is assumed to be methane. However, the same concepts apply to any other fluid controlled by a plate valve. As explained below, although methane has a low absolute viscosity, even a small gap can generate a significant damping force.

Squeeze film action is governed by the Reynolds equation as shown below:

$$\frac{\partial}{\partial x}\left(\frac{h^3}{\mu}\frac{\partial p}{\partial x}\right)+\frac{\partial}{\partial z}\left(\frac{h^3}{\mu}\frac{\partial p}{\partial z}\right)=6(U_1-U_2)\frac{\partial h}{\partial x}+6h\frac{\partial(U_1+U_2)}{\partial x}+12\frac{\partial h}{\partial t} \quad (1)$$

For the squeeze film problem, the lateral velocities (U1 and U2) are equal to zero, reducing Equation (1) to:

$$\frac{\partial}{\partial x}\left(\frac{h^3}{\mu}\frac{\partial p}{\partial x}\right)+\frac{\partial}{\partial z}\left(\frac{h^3}{\mu}\frac{\partial p}{\partial z}\right)=12\frac{\partial h}{\partial t} \quad (2)$$

Equation (2) may be solved with a variety of numerical schemes. For the purpose of proving the above concept, a circumferential land around the perimeter of the valve 30 can be considered where the pressure gradient in the circumferential direction can be ignored. Equation (2) reduces to:

$$\frac{\partial}{\partial x}\left(\frac{h^3}{\mu}\frac{\partial p}{\partial x}\right)=12\frac{\partial h}{\partial t} \quad (3)$$

The pressure equation may be solved for by double integration of Equation (3), and applying boundary conditions at x=0 and x=L, where L=half width of the land, resulting in:

$$p(x)=\frac{6\mu V}{h^3}(L^2-x^2) \quad (4)$$

The total force acting on the circular land can be solved by integrating this pressure over the area resulting in:

$$F=\frac{8\pi\mu DL^3V}{h^3}$$

where,

μ=absolute viscosity of gas
D=outside diameter of valve
L=half width of squeeze film land
V=valve impact velocity
h=gap between valve plate and valve body Equation (5) shows that the force, F, increases in a cubic fashion with the decreasing gap. Therefore, as the valve 30 closes, the squeeze film forces increases rapidly as impact approaches. This is preferred behavior since the damper will not affect the opening characteristics of valve 30, but will act to decelerate the valve to avoid high impact velocity.

To prove the concept, the following example is presented:

Valve diameter=200 mm (8")
Width of squeeze film land (2 L)=25 mm (1")
Plate valve velocity=3 m/s
Absolute viscosity (methane)=1.3e-5 N-2/m^2

FIG. 5 illustrates the damping force, which increases as the gap decreases. As the table shows, significant damping force can be achieved as the plate nears contact with the valve body. The valve should remain nearly parallel in order to achieve this beneficial effect.

What is claimed is:

1. A compressor plate valve, comprising:

a valve seat having a first set of passage channels;

a valve guard having a second set of passage channels;

a valve plate having a third set of passage channels, the valve plate being disposed between the valve seat and the valve guard and moveable between them to control the passage of fluid through the valve;

a valve stem attached at a first end to a center of the valve plate and passing through a center of the valve guard;

wherein the valve seat, valve guard and the valve plate have sealing surfaces that oppose passage channels; and wherein the valve seat, valve guard and valve plate have landing surfaces;

wherein each landing surface of the valve seat opposes, directly or indirectly, landing surfaces of the valve guard and valve plate, and does not oppose any passage channel, such that three landing surfaces are aligned vertically; and wherein a center landing surface of each of the valve seat, of the valve guard, and of the valve plate is centered around the valve stem, and the center landing surface of the valve guard is at least as wide as that of the valve plate;

wherein the landing surfaces of the valve seat, valve guard and valve plate, respectively, comprise more than half of a total surface of the valve seat, valve guard and valve plate, respectively.

2. The compressor plate valve of claim 1, further comprising a bushing attached to the valve guard to form a sleeve around the valve stem.

3. The compressor plate valve of claim 1, wherein the center landing surface comprises more than ¼ of the inner portion of the total valve diameter.

4. The compressor plate valve of claim 1, wherein the landing surfaces comprise at least an outer landing surface at the outer diameter of the valve plate, valve guard and valve seat.

5. The compressor plate valve of claim 4, wherein the outer landing surface comprises at least ⅛ of the outer portion of the total valve diameter.

6. A method of providing a compressor plate valve for controlling the passage of fluid, comprising:

providing a valve seat having a first set of passage channels;

providing a valve guard having a second set of passage channels;

providing a valve plate having a third set of passage channels, the valve plate being disposed between the valve seat and the valve guard and moveable between them to control the passage of fluid through the valve;

providing a valve stem attached at a first end to a center of the valve plate and passing through a center of the valve guard;

wherein the valve seat, valve guard and the valve plate have sealing surfaces, which are surfaces that oppose passage channels; and wherein the valve seat, valve guard and valve plate have landing surfaces;

wherein each landing surface of the valve seat opposes, directly or indirectly, landing surfaces of the valve guard and valve plate, and does not oppose any passage channel, such that three landing surfaces are aligned vertically; and wherein a center landing surface of each of the valve seat, of the valve guard, and of the valve plate is centered around the valve stem, and the center landing surface of the valve guard is at least as wide as that of the valve plate;

wherein the landing surfaces of the valve seat, valve guard and valve plate, respectively, comprise more than half of the surface of the valve seat, valve guard and valve plate, respectively.

7. The method of claim 6, further comprising a bushing attached to the valve guard to form a sleeve around the valve stem.

8. The method of claim 6, wherein the center landing surface comprises more than ¼ of the inner portion of the total valve diameter.

9. The method of claim 6, wherein the landing surfaces comprise at least an outer landing surface at the outer diameter of the valve plate, valve guard and valve seat.

10. The method of claim 9, wherein the outer landing surface comprises at least ⅛ of the outer portion of the total valve diameter.

* * * * *